United States Patent [19]

Mosberg

[11] Patent Number: 5,024,433

[45] Date of Patent: Jun. 18, 1991

[54] MANUALLY ADJUSTABLE ROPES SUSPENDED THEREFROM

[76] Inventor: Kaare Mosberg, Turveien 20, Groosasen, N-4890 Grimstad, Norway

[21] Appl. No.: 497,765

[22] Filed: Mar. 20, 1990

Related U.S. Application Data

[63] Continuation of Ser. No. 297,257, filed as PCT NO88/00041 on May 11, 1988, published as WO88/08730 on Nov. 17, 1988, abandoned.

[30] Foreign Application Priority Data

May 14, 1987 [NO] Norway ..... 872013

[51] Int. Cl.[5] ..... A63B 21/12; A61H 1/02

[52] U.S. Cl. ..... 272/120; 272/109; 272/112; 128/75

[58] Field of Search ..... 270/107, 109, 111, 112, 270/136, 120; 294/82.13, 82.14, 82.17; 128/70, 75

[56] References Cited

U.S. PATENT DOCUMENTS

| | | | |
|---|---|---|---|
| 3,981,500 | 9/1976 | Ryan | 272/136 |
| 4,125,257 | 11/1978 | Lew | 128/75 |
| 4,574,789 | 3/1986 | Forster | 272/900 |

FOREIGN PATENT DOCUMENTS

| | | | |
|---|---|---|---|
| 2331317 | 1/1975 | Fed. Rep. of Germany | 272/112 |

*Primary Examiner*—Stephen R. Crow
*Attorney, Agent, or Firm*—Ladas & Parry

[57] ABSTRACT

A manually adjustable apparatus (1) for hoisting pressing, stretching and keeping-fit exercises comprising a bar (2) and two ropes (3) provided with supporting loops (4). The ropes (3) independently extendable and shortenable, and the ropes are temporarily lockable in and releasable from cleat locks (7) by simple manipulation of the ropes and optionally of the bar (2). The bar is preferably suspended in an articulated way from a roof structure (9), so that the bar is swingable by movement of the ropes (3). Optionally, the bar is provided with rope pulleys (5,5') and rope guides (8) guiding the ropes (3) in desired directions.

4 Claims, 3 Drawing Sheets

MANUALLY ADJUSTABLE ROPES SUSPENDED THEREFROM

This is a continuation of copending application Ser. No. 07/297,257 filed as PCT NO88/00041 on May 11, 1988, published as WO88/08730 on Nov. 17, 1988.

The present invention relates to an apparatus for hoisting, pressing, stretching and keeping-fit exercises comprising a bar and two manually adjustable ropes each provided with supporting loops.

For a substantial time period conventional gymnastics rings were used for hoisting and pressing exercises both to rebuild a weakened body and for keeping-fit. Rings were also used for stretching or straining exercises, and the like with the user hanging from the rings at a certain level above the floor. Such conventional rings, however, were not very convenient to a person requiring a frequent changing of the exercises. For the various exercises it would be convenient to enable readjustment or resetting of the level of the rings above the floor in a simple and rapid manner.

By the apparatus according to the invention a variety of exercises can readily be achieved for rebuilding physical strength, keeping fit, and the like, independently of the length of the user. The user may, based on his or her own strength and desire, adapt the exercises to a selected force which is to be used for the various hoisting, pressing and stretching exercises. Thus, the user may combine any exercises, e.g. arm hoisting and leg pressing, stretching and leg pressing, stretching and leg pressing and arm pressing and leg pressing.

According to the invention this is achieved by an apparatus of the aforesaid kind which includes means for suspending the bar and the bar includes rope guides for turning the direction of the ropes, and associated cleat locks for temporarily locking the respective ropes whereby the ropes are easily releasable by withdrawing movements of the rope.

Preferably the bar is suspended from a roof (ceiling) structure by an articulated link to enable swinging movements of the bar by means of the ropes.

Optionally the bar is provided with rope pulleys and rope guides to guide the ropes in the desired directions.

The bar may be provided with a projection to which the cleat locks are secured. If desired, the bar may be provided with means for suspending the ropes.

The cleat locks may optionally be replaced by power driven winding means permitting remote operation for use by handicapped persons.

It is convenient for the bar proper to be designed to provide a suitable handgrip to permit straining exercises whereby the user is suspended from the bar.

These and other objects, features and advantages will appear from the following disclosure of two embodiments of the invention which is at present preferred and is shown in the drawings for illustrating purposes.

BRIEF DESCRIPTION OF THE DRAWINGS

In FIG. 1 reference number 1 designates the complete manually adjustable hoisting, pressing, stretching and keeping-fit apparatus suspended from a roof structure 9. The apparatus 9 includes a bar 2 which is suspended from the roof structure 9 via suspension means 10 which is preferably an articulated link. The link is preferably arranged in such a way that bar 2 is able to swing slightly in a direction perpendicular to its longitudinal direction. The bar 2 is provided with a projecting bracket 6 near its center and cleat locks 7 are secured to said bracket. Furthermore, the bar 2 is internally provided with outer pulleys 5 and inner pulleys 5'. Said pulleys may obviously be replaced simply by shafts or guiding means in order to simplify the structure (FIG. 4). A rope 3 runs over and between the pairs of pulleys 5,5' and extend downwards and out of the bar 2 at each end through guides 8. The ropes also extend downwards and out of bar 2 centrally, through cleat locks 7 and then hang down freely. At the opposite ends of the ropes 3 gripping loops 4 are provided. Said gripping loops 4 may consist of a flat padded material of such a design and dimension suitable for a wrist, or, if desired, an ankle or a heel. In addition the loops 4 are designed in such a way that rings having a suitable outside profile can be inserted in the loops 4 in order to act as gymnastics rings. Naturally, these rings may have a circular configuration or, if desired, a more triangular configuration.

FIG. 2 presents the apparatus in an end view clearly indicating the cross sectional profile of the bar 2. As shown the upper portion of the bar may be rounded to provide a good handgrip. The pulleys 5 are rotatable via axles inside the bar profile. Suspending means 10 is secured to the roof structure 9, e.g. by the aid of French wood screws or other suitable fastening means. As shown in FIG. 2, the suspending means 10 is a linkage permitting swinging movement perpendicular to the longitudinal dimensions of the bar 2. The guide 8 provides good control of the rope 3 and causes a smooth and even junction for the rope 3 when swinging aside, as indicated by broken lines.

FIG. 3 presents a sectional view of the central portion of bar 2 including a mounted inner pulley 5', which is freely rotatable inside the bar profile. As previously stated, a projecting bracket 6 is attached to the central portion of bar 2, e.g. by a welded connection or a screw connection. The cleat locks 7 are in turn, secured to the bracket 6. The cleat locks 7 are of a kind known per se and are commonly used inter alia in yachts such as sailing boats, for rapid and reliable locking and releasing of ropes or lines. An example of such cleat lock made of a plastic material is a CLAMCLEAT (reg. trade mark) cleat lock. The locks 7 have a cross sectional profile presenting an internal wedge shape in which the rope 3 is inserted, the wedge shape being tapered towards the base of the lock. In addition, the side walls of the cleat lock are provided with inclined grooves, as indicated in FIG. 3. By moving the rope 3 upwards (FIG. 3) the rope is guided upwardly and into the cleat by means of said grooves which provides a reliable and quite immediate locking of the rope. When the rope is to be released for adjustment the rope 3 must be pulled downwards (according to FIG. 3) and out of the wedge, as indicated by broken lines. In this way the level of the gripping loops 4 can readily be adjusted by simple manipulation of the ropes 3 out of and into the cleat locks 7.

Figure 1:
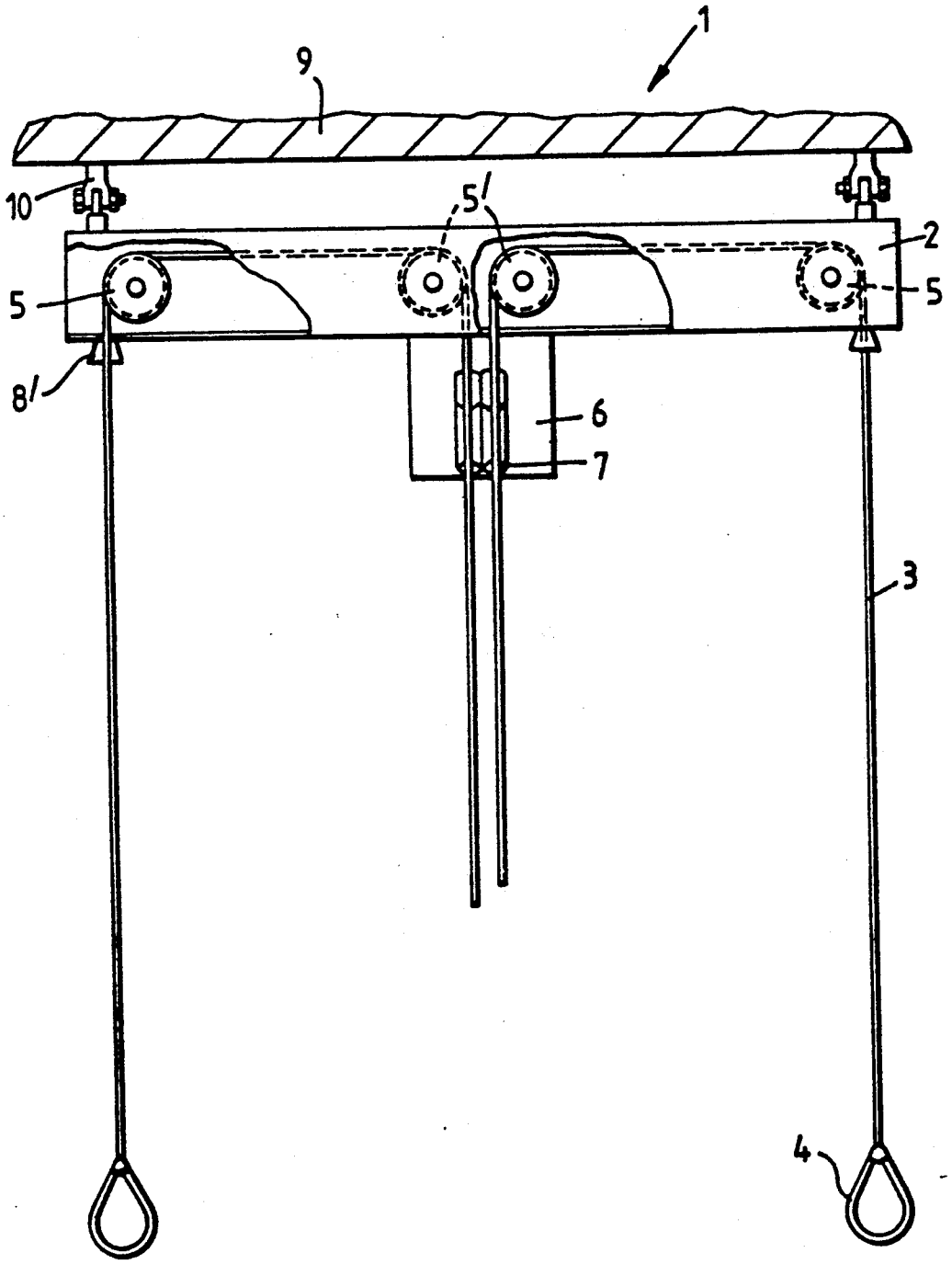
FIG. 1 is a diagrammatical view of the manually adjustable hoisting, pressing, stretching and keeping fit apparatus according to the present invention.
Figure 2:
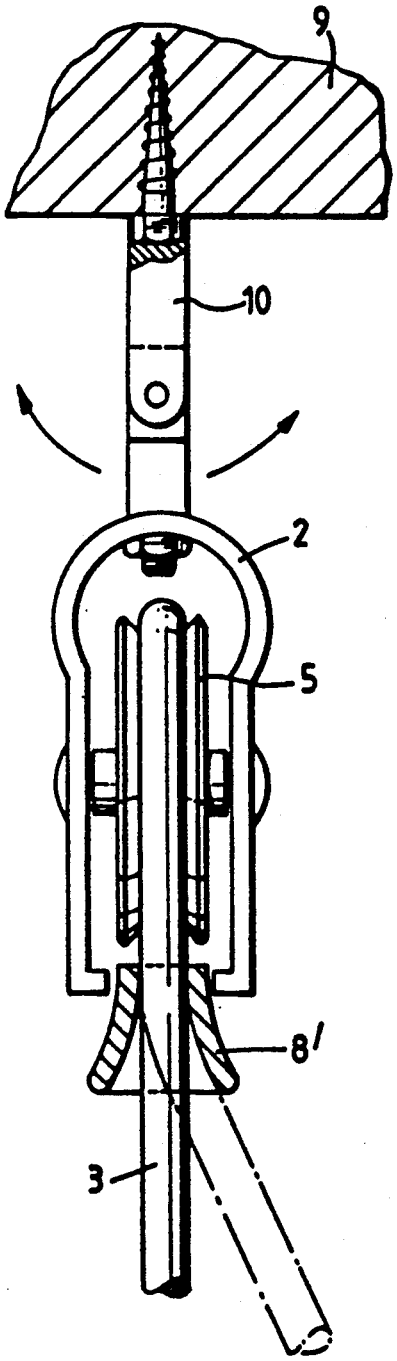
FIG. 2 presents the apparatus according to FIG. 1 in an end view.
Figure 3:
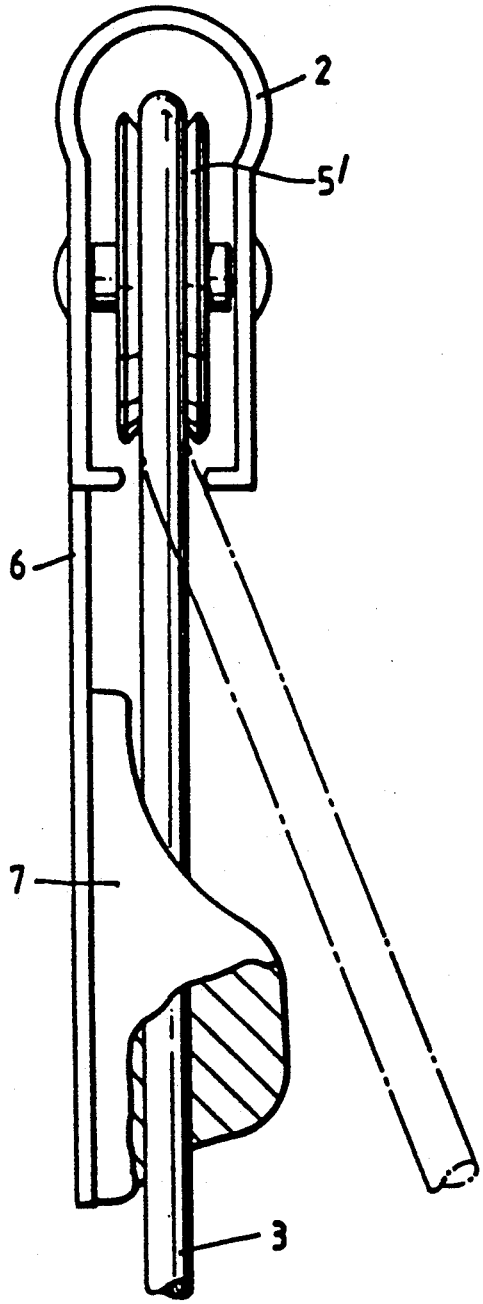
FIG. 3 presents the apparatus according to FIG. 1 partly in section of the central area of the apparatus.
Figure 4:
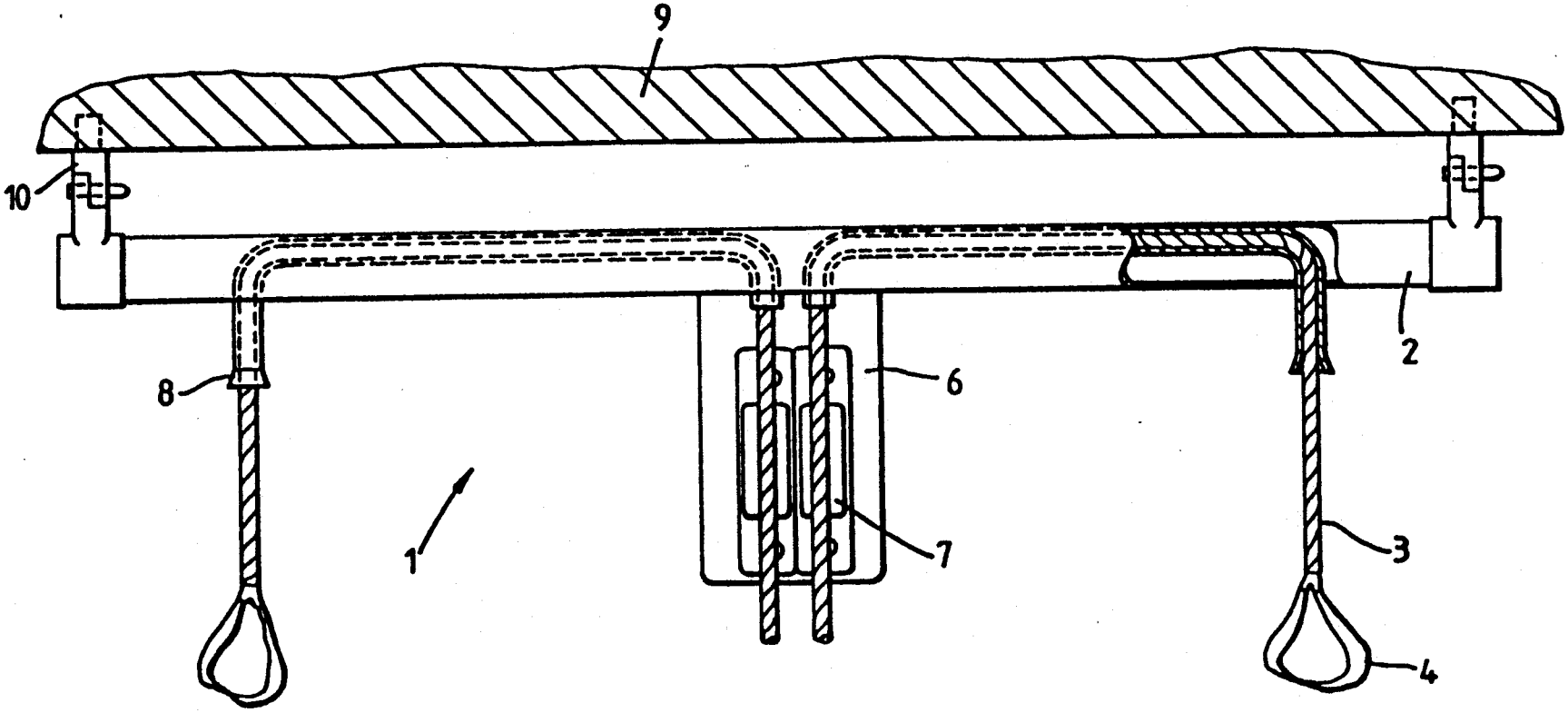
FIG. 4 presents a diagrammatical view of a second embodiment of the apparatus according to the invention.

The apparatus may also be provided with a hook (not shown) or the like supporting a wound up coil of rope. The suspension means 10 including its linkage is, preferably, provided with a rapidly removable pivot for simple disassembly of the entire apparatus when it is to be used elsewhere.

I claim:

1. A physical exercise apparatus with a bar having a pair of manually adjustable ropes, comprising a bar having internally mounted guide means for turning the direction of a pair ropes;

means for suspending said bar from a ceiling structure, said suspension means having articulating means to enable a swinging movement of said bar in a direction transversely thereof by movement of a first section of each of a pair of ropes;

said pair of ropes mounted on said guide means, each of said ropes having said first section depending from a respective end portion of said bar and each having supporting loop means for user gripping at an end of said first section, and each of said ropes having a second section depending from a central portion of said bar;

means depending from said central portion of said bar for releasably clamping a portion of said second section of each of said ropes to individually adjust a vertical position of each of said supporting loop means, said means including a mechanical member depending from said bar, said member supporting two quick-releasable cleatlock type means for engaging said ropes.

2. The physical exercise apparatus according to claim 1, wherein said guide means comprises a first pair of rope pulleys at the central portion of said bar, and a second pair of rope pulleys having a pulley at each end of said bar, and a rope guide at each end of said bar.

3. The physical exercise apparatus according to claim 1 wherein said guide means comprise a pair of tubular rope guides each extending vertically from below the central portion of said bar, through a first bend into a horizontal section towards the end of said bar and then through a further bend to extend vertically below said bar.

4. The physical exercise apparatus according to claim 1, wherein said cleat lock type means each have a horizontal cross-section profile forming an internal wedge tapered from its opening towards its base, the opposing walls of said profile having grooves forming an acute angle to the longitudinal direction of said base, the apex of said angle facing said bar, said rope being releasable from said cleatlock type means by pulling said rope downwards and out of said wedge profile.

* * * * *

UNITED STATES PATENT AND TRADEMARK OFFICE

CERTIFICATE OF CORRECTION

PATENT NO. : 5,024,433

DATED : June 18, 1991

INVENTOR(S) : Kaare MOSBERG

It is certified that error appears in the above-identified patent and that said Letters Patent is hereby corrected as shown below:

On the Title page and in col. 1:

Please delete the title and substitute therefor --SUSPENDED EXERCISE BAR HAVING MANUALLY ADJUSTABLE ROPES SUSPENDED THEREFROM--.

Signed and Sealed this

Twenty-ninth Day of June, 1993

Attest:

Michael K. Kirk

MICHAEL K. KIRK

Attesting Officer

Acting Commissioner of Patents and Trademarks